US005097647A

United States Patent [19]

Sopik et al.

[11] Patent Number: 5,097,647

[45] Date of Patent: Mar. 24, 1992

[54] SUPPORT TOWER FOR COMMUNICATIONS EQUIPMENT

[75] Inventors: Jeffrey A. Sopik, Scarborough; Leslie Rebanks, Toronto; John E. Pepper, Scarborough; Frank D. Y. Cheng, Thornhill; Robert Halsall, Toronto, all of Canada

[73] Assignee: Canadian Communications Structures Inc., Scarborough, Canada

[21] Appl. No.: 610,896

[22] Filed: Nov. 9, 1990

[51] Int. Cl.[5] ..... E04H 12/20; E04C 3/30

[52] U.S. Cl. ..... 52/648; 52/731; 343/878; 343/890; 405/227

[58] Field of Search ..... 52/730, 40, 648, 731, 52/721, 638, 654, 695; 405/227; 343/890, 878

[56] References Cited

U.S. PATENT DOCUMENTS

| | | | |
|---|---|---|---|
| 3,119,471 | 1/1964 | Turner | 52/654 |
| 3,562,994 | 2/1971 | Von Linsowe | 52/695 X |
| 4,126,864 | 11/1978 | Hopkins | 52/24 |
| 4,241,117 | 12/1980 | Figge | 52/731 |
| 4,745,412 | 5/1988 | Creaser, Jr. | 52/638 |

OTHER PUBLICATIONS

Catalog of Microwave Tower by Tower Construction Co., Sioux City, Iowa, made available Dec. 22, 1959, see pp. 12, 13, and 16.

*Primary Examiner*—David A. Scherbel
*Assistant Examiner*—Kien Nguyen
*Attorney, Agent, or Firm*—Rogers, Bereskin & Parr

[57] ABSTRACT

The support tower comprises three (3) generally parallel legs positioned relative to one another to form a triangular configuration and each leg having a bottom end and a top end. A plurality of cross bracing is provided securing the legs to one another intermediate their ends. A first mount is located adjacent the top ends of the legs and is capable of supporting pivotally and slidably a microwave dish. A second mount is located on each leg for mounting cellular antennas generally back to back. The tower further includes an albow adjacent each top end of the legs wherein the elbow displaced the legs outwardly to increase the lateral spacing between the top ends of the legs.

13 Claims, 5 Drawing Sheets

SUPPORT TOWER FOR COMMUNICATIONS EQUIPMENT

FIELD OF THE INVENTION

This invention relates to support towers in general, and in particular relates to support towers of the type that are used to support communication equipment, such as microwave dishes or cellular telephone network antennas.

BACKGROUND OF THE INVENTION

Support towers for communication equipment have in the past conventionally been of lattice-type construction. In such construction, the towers are provided with a relatively broad base, typically having a rectangular cross-section, which narrows significantly towards the top of the tower. Much cross-bracing is used in the tower, and the overriding design criteria for such towers has been to erect the tallest tower with the least amount of steel. This provides a relatively inexpensive structure, but one which requires a significant amount of labour to erect.

In the past, such towers have been used primarily for microwave dishes. Such dishes would be mounted either on a leg or on a tower face. However, such mounting substantially increases the wind load of the structure and thus additional steel may be required to be used in the design. If a pre-existing tower is to be modified to support an additional dish, the addition of any reinforcement can be difficult and awkward.

Recently, however, the development of the cellular telephone network, through use of a multiplicity of cellular antennas, has changed the requirements of the support towers. Typically, cellular antennas require a horizontal separation of 12–15 feet to achieve the desired receiver diversity. On a conventional tower, with an upward taper to a point, the only way to achieve the desired separation is to add long boom mounts to the tower. The addition of long boom mounts greatly effects the wind-loading and adds to the busy appearance of an already busy lattice structure. Indeed, the requirement of the addition of cellular antennas together with the long boom mounts may exceed the design loading of conventional towers and require the retro-fitting of additional cross-bracing up the length of the tower. This additional bracing further increases the busy appearance of the structure and adds to the expense of installation of the antennas.

What is desired is a new support tower structure, which is simple and easy to erect, and which provides the required degree of separation at the top without the need for overhanging boom mounts. What is also desired, is a support tower, which provides a range of azimuths for mounting microwave antennas, but which retains the antenna close to the tower structure and even partially recessed within the tower for lower wind loading, easy adjustment and the like.

BRIEF SUMMARY OF THE INVENTION

According to the present invention there is disclosed a support tower for communications equipment, such as microwave dishes or cellular antennas, said support tower comprising:

three generally parallel legs positioned relative to one another to form a triangular configuration and each having a bottom end and a top end;

a plurality of cross-bracing securing said legs to one another intermediate their ends;

a first mounting means adjacent their top ends, said first mounting means being supported between at least two legs, and being capable of pivotally and slidably supporting a microwave dish thereon;

the top ends being sufficiently spaced apart to accommodate microwave dishes on said first mounting means therebetween, said first mounting means permitting an azimuth range by reason of said pivoting and sliding;

each of said legs further including second mounting means for mounting two cellular antennas thereon generally back to back.

DESCRIPTION OF THE DRAWINGS

Reference will now be made to the following drawings which illustrate a preferred embodiment of the invention for the purposes of example only and in which.

DETAILED DESCRIPTION OF THE PREFERRED EMBODIMENT

Figure 1:
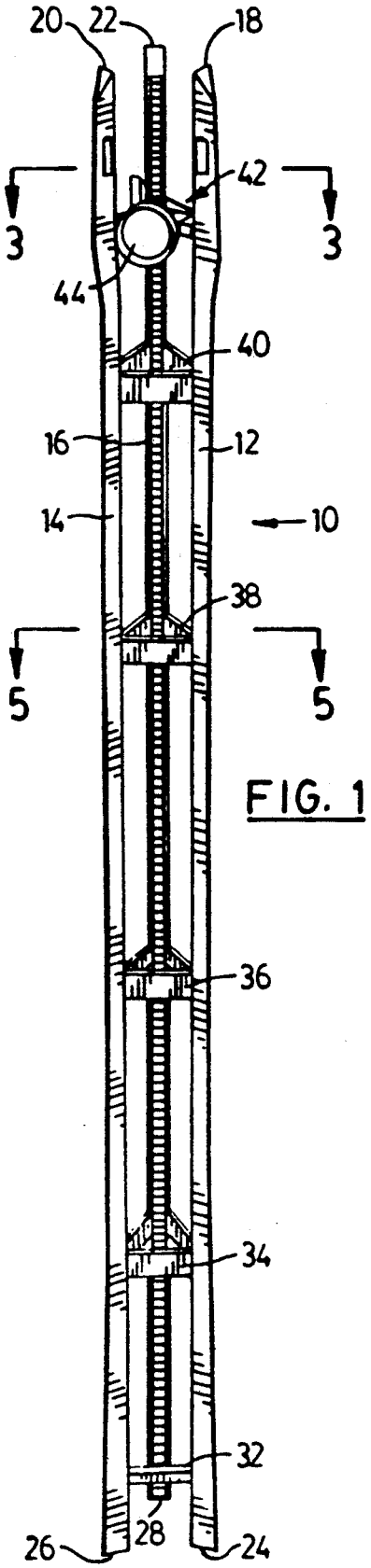
FIG. 1 is a front view from generally above of a support tower according to the present invention.

FIG. 1 shows a support tower generally indicated with reference numeral 10. The support tower 10 is comprised of three legs shown as 12, 14 and 16. Each of the legs 12, 14 and 16 have respective top ends 18, 20 and 22 and bottom ends 24, 26 and 28. Intermediate the top ends 18, 20 and 22, and the bottom ends 24, 26 and 28, are located a number of cross-braces, which are identified as 32, 34, 36, 38 and 40. In addition, there is a rigid support adjacent the top ends, which is indicated as 42.

The cross-bracing 32, 34, 36, 38 and 40 is preferably in the form of steel members having a height much greater than their thickness. Each such member extends between adjacent legs to form, in essence, a low wall. The significance of the low wall will be described below.

Figure 2:
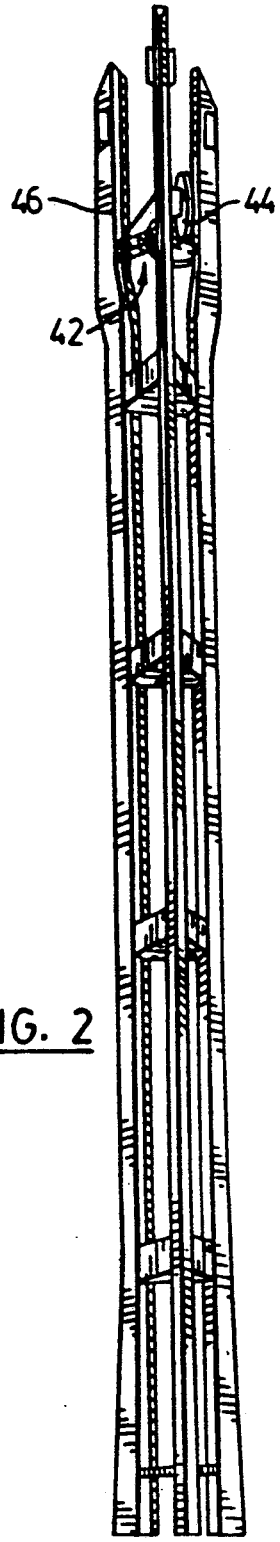
FIG. 2 is a view from generally below of a support tower according to the present invention.

FIG. 2 shows the support tower of FIG. 1, but from a perspective of below rather than above. Also shown in FIG. 2, are microwave dishes 44 and 46 mounted on rigid support 42 which is in essence a fist mounting means.

Figure 3:
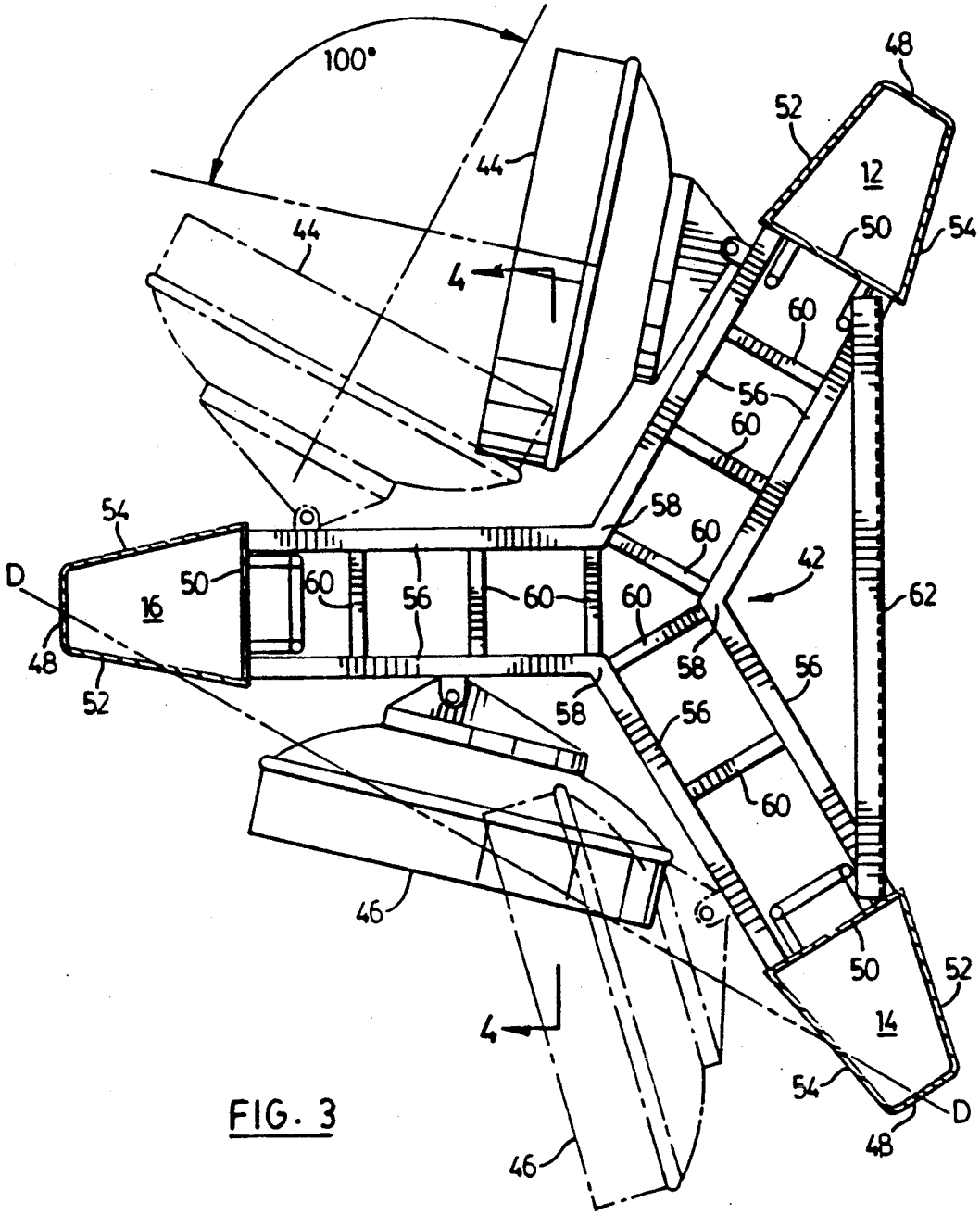
FIG. 3 is a cross-section through lines 3—3 of FIG. 1 illustrating the mounting of microwave dishes on the support tower.

FIG. 3 shows a cross-section through the tower of FIG. 1 along the lines 3—3 which provides a sectional view through each of the legs 12, 14 and 16. As can be seen from FIG. 3, each leg 12, 14 and 16 is of generally trapezoidal cross-section. Each leg has an outer face 48 parallel to and opposite an inner face 50. Each leg also has side faces 52 and 54 which converge outwardly and connect inner face 50 to outer face 48. It will be appreciated by those skilled in the art that while the trapezoidal configuration illustrated is preferred, other geometric configurations may also be appropriate. For example, cylindrical or semi-circular members may achieve the desired strength while at the same time performing the same function. However, for reasons as will become apparent below, the generally trapezoidal section is preferred.

FIG. 3 also shows the rigid support 42 in more detail. Essentially, the rigid support 42 consists of pairs of parallel support elements 56 which are connected at one end to the inner faces 50 of the legs and at the other end are joined to an adjacent support element 56 at the joint 58. Extending between the parallel support elements 56 are a number of cross-supports 60. These elements, 56 and 60 can be joined in any conventional manner, such as by bolts, welding or the like. The purpose of the rigid support 42 is two-fold. Firstly, it provides rigid support between the legs 12, 14 and 16 adjacent their upper end, and secondly, it provides a place upon which a microwave dish may be mounted. It will be appreciated by those skilled in the art that any cross-section of structural members could be used for building up rigid support 42. The drawings illustrate hollow square channel members, but providing sufficient strength is provided, the members could be of any cross-sectional shape. The preferred fabrication method is welding, but other known techniques would also be suitable. In FIG. 3 the microwave dishes are shown as 44 and 46 respectively, and they are shown in a first position in solid outline and in a second position in dotted outline. The mounting means which permits the range of movement is described below.

Also shown in FIG. 3 is a removable hoist beam 62. Removable hoist beam 62 may be fastened between any of the legs 12 and 14, 14 and 16 or 16 and 12 and provides a temporary hoisting point, which may be used to raise and position microwave dishes appropriately for attachment to the support tower 10 at the first mounting means. After installation of the microwave dish is complete, the temporary or removable hoist beam 62 may be removed.

Figure 4:
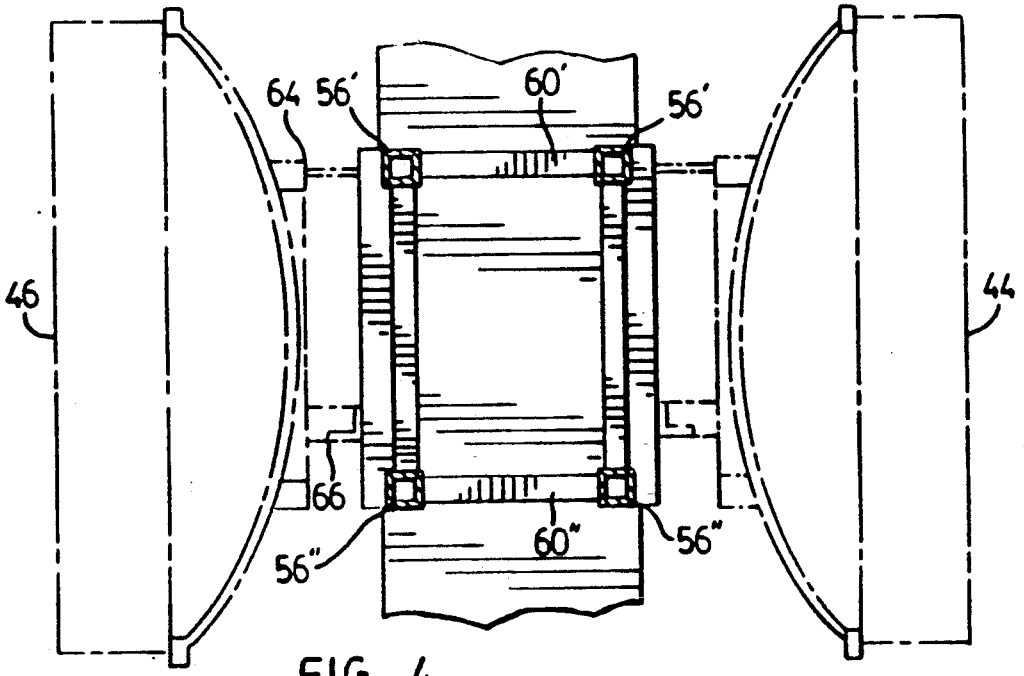
FIG. 4 is a cross-section through lines 4—4 of FIG. 3.

Referring now to FIG. 4, which is a cross-section through lines of 4—4 of FIG. 3, it will be appreciated how the rigid support 42 is made. Essentially, rigid support 42 consists of upper members $56^{1}$ and lower members $56^{11}$. The microwave dishes 44 and 46 are shown in dotted outline in FIG. 4, with a pivoting connection both at the top 64 and at the bottom 66. These pivoting connections 64 and 66 enable the microwave dishes 44 and 46 to be positioned in a desired direction. In addition, the dishes 44 and 46 are located in channels which run horizontally the length of the rigid support 42 and which allow the dishes to be positioned anywhere along its length. Thus, by being positionable laterally, and by being pivotally mounted a range of azimuths can be accommodated.

Figure 5:
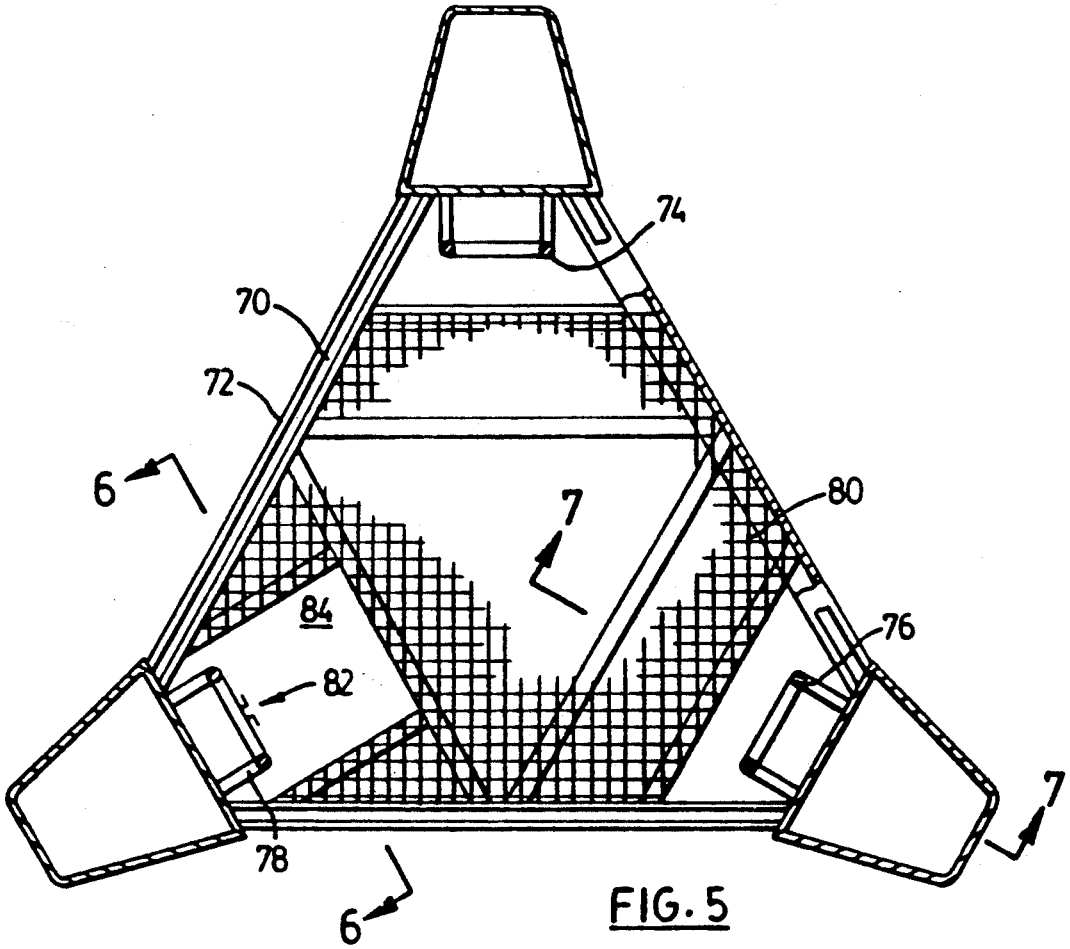
FIG. 5 is a cross-section through lines 5—5 of FIG. 1.

FIG. 5 shows a top view of a cross-bracing 32, 34, 36, 38 or 40. The cross-bracing preferably includes a hand rail 70 which sits above a channel 72. Also shown are two microwave guides 74 and 76 as well as an access ladder 78. A platform grate 80 extends across between the channels 72 to form a support platform. The access ladder 78 includes a safety rail 82. The access ladder 78 extends upwardly through an access hole 84 formed in the grid 80.

Figure 6:
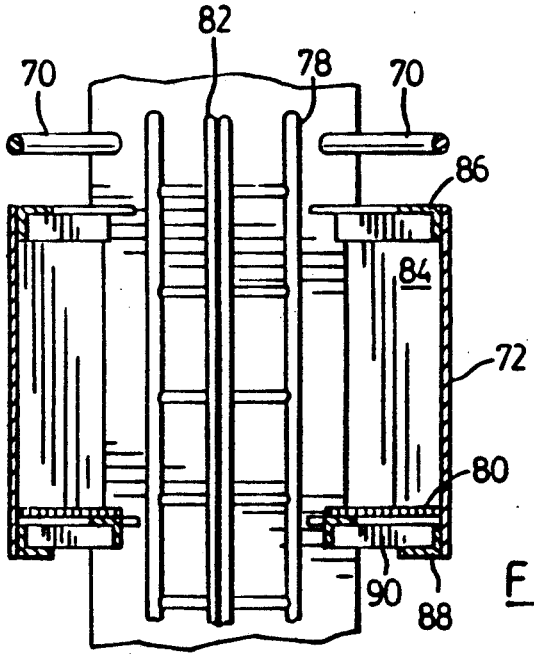
FIG. 6 is a cross-section through lines 6—6 of FIG. 5.

FIG. 6 shows a side view of the access ladder 78 with the safety rail 82. In addition, the hand rail 70 is shown in part section. Also shown is the channel 72 which is a built up channel. Preferably, said channel 72 is comprised of a flat plate 84 to which are attached at the upper and lower ends angles 86 and 88 respectively. Lower angle 88 in turn supports a cross-support 90 upon which the grate 80 rests. It will be appreciated by those skilled in the art that these elements could be secured together by any conventional means, such as welding, bolts or the like, and that other configurations of cross-brace are appropriate. What is desired is to ensure that adequate strength is provided to the cross-brace structure to rigidly support the legs 12, 14 and 16 under the different load conditions to be experienced by the support tower 10. It will now be appreciated that the steel members form a low wall which surrounds the platform grate 80, thus increasing the safety at the platform.

Figure 7:
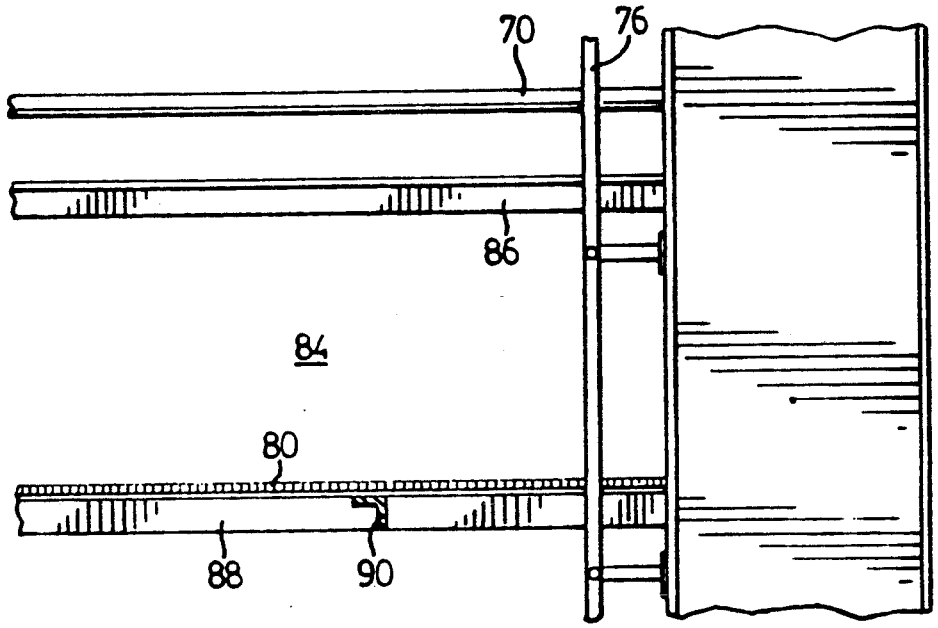
FIG. 7 is a cross-section through line 7—7 of FIG. 5.

Turning to FIG. 7, a second cross-sectional view is shown of a typical platform in which like elements have been marked with like numerals.

Figure 8:
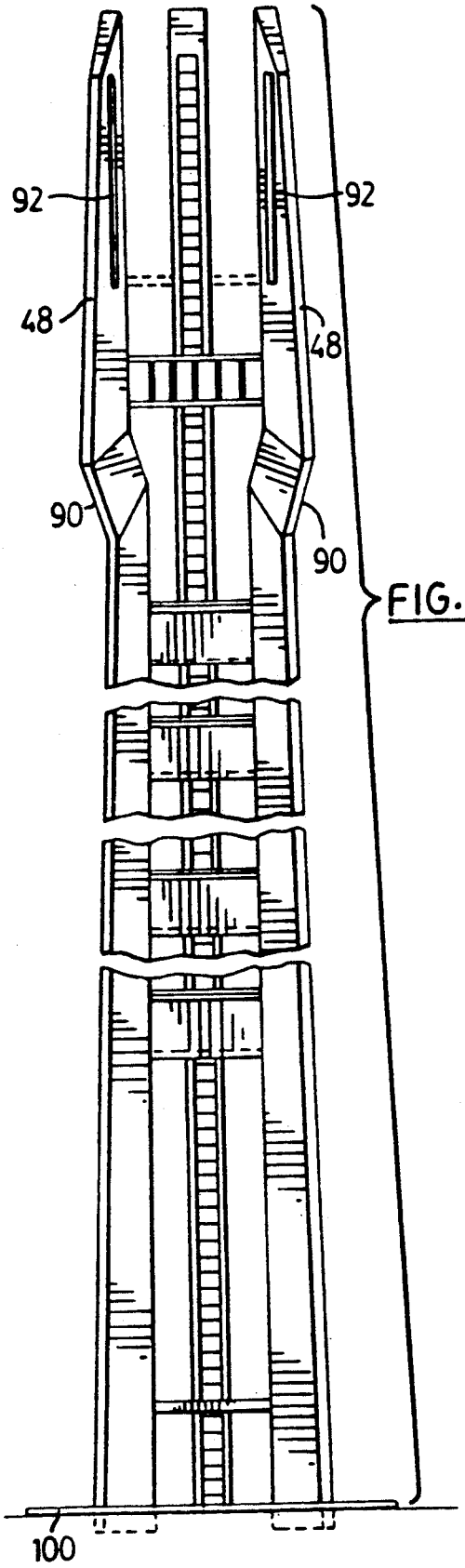
FIG. 8 is a sectional view showing the tower erected and installed on a base.

Turning now to FIG. 8, it can be seen that the support tower 10 consists of legs 13, 14 and 16 which are generally parallel along an inner edge, but which have gradually tapering cross-sections whereby the outer faces 48 converge towards the top. However, adjacent the top an elbow is provided which again displaces outwardly each of the legs from one another. The elbow is shown in FIG. 8 as 90. The elbow is located below the rigid support 42. It will be appreciated by those skilled in the art that by including an elbow at this position, it is possible to outwardly space the upper ends 18, 20 and 22 of the legs. This has the advantage of allowing a great proportion of the height of the tower to be narrow in cross-section, while at the same time allowing enough space at the top to accommodate larger microwave dishes.

On each side face of each leg adjacent the upper end are located tracks 92. Tracks 92 are a means for supporting cellular antenna. Essentially, the tracks 92 have to be displaced far enough from one another to achieve the required cellular diversity. The three-leg configuration of this support tower 10 enables 12 cellular antenna to be mounted to double the cellular network density above a conventional 3 antenna mounting. When configured for sectorization, with 12 antenna mounted, the front to back ratio of the cellular antennas is a very important consideration. It will be appreciated by those skilled in the art that a higher ratio and thus a better system performance can be obtained with this support tower 10 than for conventional lattice type construction. The better performance occurs because of the size of the legs (i.e. lateral distance between the antenna) and because the legs are formed from steel. In other words, the front to back ratio of the antennas will be improved since the tower leg will block much of the radiated power at the rear of each antenna.

Figure 9:
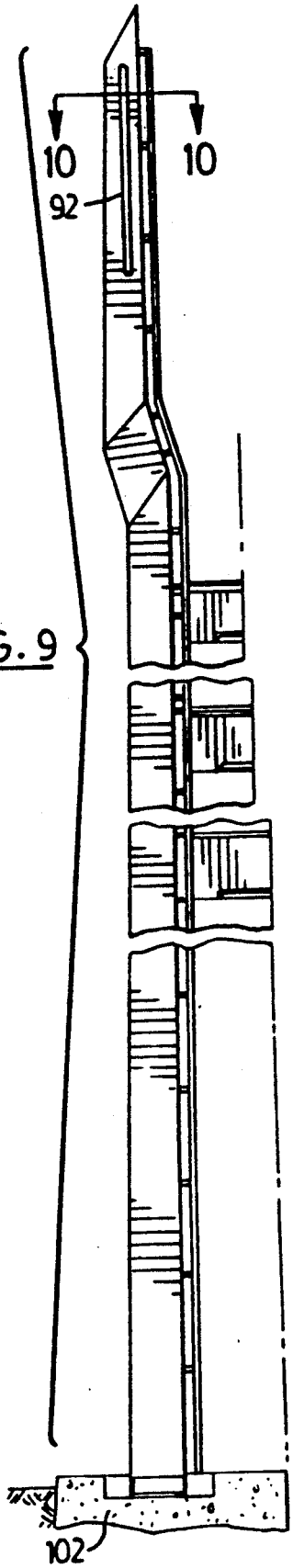
FIG. 9 shows a sectional view of one leg of the tower.

Also shown is a typical mounting of the base of the support tower 10 which involves either a flat steel plate 100 which can be secured to the ground by any conventional means, or a concrete foundation 102 as shown in FIG. 9. It will be appreciated by those skilled in the art that adequate foundations need to be provided in accordance with conventional engineering principles.

Figure 10:
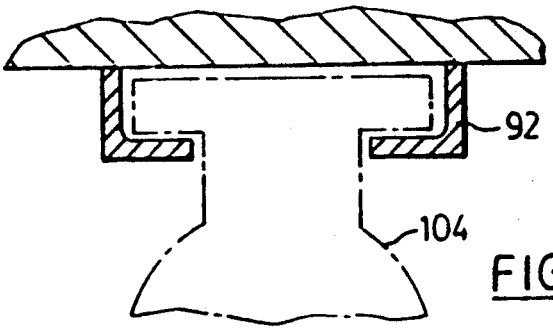
FIG. 10 is a cross-sectional view through lines 10—10 of FIG. 9.

Referring to FIG. 10, a cellular antenna 104 is shown in ghost outline. In enlarged cross-section is also shown low profile channel 92 within which the cellular antenna 104 is secured. Preferably, the cellular antenna 104 will be secured in place by bolts or the like which can be easily attached and detached by hand. As will be appreciated by those skilled in the art, there are many conventional securing means which would be appropriate.

It can now be appreciated why the trapezoidal cross-sectional profile is preferred for the legs 12, 14 and 16. Firstly, this provides a smooth inner face upon which to mount the microwave guides and the human access ladder. Secondly, it provides, at the top, two opposed side faces, separated by the steel leg upon which cellular antenna can be mounted. Lastly, it provides an easy configuration for fabrication.

The support tower 10 is preferably built to three heights, namely 40 meters, 50 meters or 60 meters. However, the different heights are mere matters of preference and do not define any essential feature. For the different heights, the support tower 10 will function identically. It will be apparent from the foregoing description that proper horizontal separation of cellular antennas can be accomplished with the support tower 10 without the necessity of using cross boom amounts and in addition, that a wide range of obtainable azimuths is achievable for microwave dishes.

An aspect of the present design is the fact that the mounting of the microwave dishes is recessed relative to the outside of the structure. This is different than conventional structures which require the microwave dish to be hung on the outside of the structure. Referring to FIG. 3 a line D-D can be extended between the center line of two outside faces of adjacent legs. In all cases, the mounting point of the microwave dish will be inside of this line. This reduces the profile of the tower and aside from improving the appearance of the tower, reduces the wind loading.

It will also be appreciated that the wide range of azimuth provided to microwave dishes is due to each dish being mounted with two degrees of freedom. The first degree of freedom comes because the microwave dish can be pointed in a range of directions, merely by pivoting the dish about pivoting mountings 64 and 66. A second degree of freedom exists because the dishes can be slid along to hang from either support 56. In other words, the microwave dish can be positioned as shown in solid outline in FIG. 3, or in ghost outline or at any place therebetween.

It will be appreciated by those skilled in the art that the foregoing description relates to preferred embodiments and that many variations are possible within the broad scope of the claims. Some of these variations are identified in the foregoing description, and others will be apparent to those skilled in the art. For example, while the trapezoidal cross-section of the leg is preferred, other cross-sectional shapes may function adequately as well. Further, while the preferred material is steel, other composite materials may provide adequate strength at an acceptable cost.

We claim:

1. A support tower for communications equipment, such as microwave dishes or cellular antennas, said support tower comprising:

three generally parallel legs positioned relative to one another to form a triangular configuration, each leg having a bottom end, a top end, and an elbow adjacent said top end, said elbow displacing said top ends of said legs outwardly relative to said legs below said elbow to increase lateral spacing between said top ends of said legs;

a plurality of cross-bracing securing set legs to one another intermediate their ends;

a first mounting means adjacent their top ends, said first mounting means being supported between at least two (2) legs, and being capable of pivotally and slidably supporting a microwave dish thereon;

the top ends, by reason of said elbows, being sufficiently spaced apart to accommodate microwave dishes on said first mounting means between the top ends of the legs, and wherein said first mounting means permitting an azimuth range by reason of said pivoting and sliding;

each of said legs further including second mounting means for mounting at least one cellular antenna thereon.

2. A support tower as claimed in claim 1 wherein each leg is of trapezoidal cross-section, with two side faces angled toward each other going outwardly, and a parallel inner and outer face, wherein the inner face is greater in length than the outer face.

3. A support tower as claimed in claim 2 wherein said first mounting means comprises a rigid support which extends inwardly, perpendicular to each of said inner faces of each of said legs, to a central joint, and a track, mounted on said rigid support, for mounting said microwave dish thereon.

4. The support tower as claimed in claim 3 wherein said microwave dish, when mounted on said track, is mounted at a point interior of a line formed between the centers of the outer face of the two adjacent support legs, the microwave dish thus being recessed into the support tower.

5. The support tower as claimed in claim 1, wherein second mounting means comprises a vertically oriented track on said opposed faces, said opposed faces being side faces of said legs, said cellular antennas being mountable thereon at any desired height.

6. The support tower as claimed in claim 2 wherein said tower includes at least one access ladder mounted on one of said inner faces of said leg.

7. The support tower as claimed in claim 6 wherein said tower includes a microwave guide mounted on an inner face of another leg from the one said access ladder is mounted upon.

8. The support tower has claimed in claim 1 wherein each of said legs further includes two second mounting means on opposed side faces, each for mounting a cellular antenna thereon said antennas when so mounted being generally back to back.

9. The support tower as claimed in claim 1 wherein said cross-bracing includes members having a height much greater than their thickness, which form a low wall, and which support a platform grate.

10. The support tower as claimed in claim 1 further including a removable hoist beam for raising and supporting microwave dishes in place, while said dishes are being secured to said first mounting means.

11. The support tower as claimed in claim 10 wherein said removable hoist is supported between any pair of adjacent legs.

12. The support tower as claimed in claim 5 wherein said legs are made from steel, and said legs improve the front of back ratio of my cellular antenna mounted thereon by blocking much of the radiated power at the rear of each antenna.

13. The support tower as claimed in claim 1 wherein said first mounting means permits an azimuth range of about 100°.

* * * * *